United States Patent [19]

Bayliss, Sr.

[11] Patent Number: 4,662,042

[45] Date of Patent: May 5, 1987

[54] METHODS AND APPARATUS FOR LUBRICATING A CHEEK PLATE OF A TEXTILE CRIMPING MECHANISM

[75] Inventor: Jack B. Bayliss, Sr., Charlotte, N.C.

[73] Assignee: Celanese Corporation, New York, N.Y.

[21] Appl. No.: 848,654

[22] Filed: Apr. 7, 1986

[51] Int. Cl.[4] ..... D02G 1/12

[52] U.S. Cl. ..... 28/269

[58] Field of Search ..... 28/263, 268, 269, 270

[56] References Cited

U.S. PATENT DOCUMENTS

| | | | |
|---|---|---|---|
| 3,600,776 | 8/1971 | Aoki et al. | 28/269 |
| 3,618,183 | 11/1971 | Funk et al. | 28/269 |
| 3,662,439 | 5/1972 | Baken | 28/269 |
| 3,800,373 | 4/1974 | Fleissner | 28/263 X |
| 4,589,173 | 5/1986 | Fleissner | 28/269 |

FOREIGN PATENT DOCUMENTS

| | | | |
|---|---|---|---|
| 0108705 | 5/1984 | European Pat. Off. | 28/268 |

*Primary Examiner*—Robert R. Mackey

*Attorney, Agent, or Firm*—Robert J. Blanke

[57] ABSTRACT

Textile fibers are crimped by rotating opposed crimping rolls about spaced rotary axes to force-feed the fibers through a nip defined by the rolls and into a stuffer box. A pair of cheek plates are pressed against the ends of the rolls such that a front face of each cheek plate retains the fibers against lateral displacement from the nip, and such that the center of each cheek plate is offset relative to the nip in a direction toward one of the rotary axes. Lubricant is pumped through a passage extending centrally through each cheek plate and onto the front face thereof.

4 Claims, 4 Drawing Figures

METHODS AND APPARATUS FOR LUBRICATING A CHEEK PLATE OF A TEXTILE CRIMPING MECHANISM

BACKGROUND AND OBJECTS OF THE INVENTION

The present invention relates to the crimping of textile fibers.

A conventional technique for crimping textile fibers, especially synthetic fibers, involves advancing the fibers, or tow, into a stuffer box which resists the rate of egress of the tow from the box. The tow is advanced into the box by a pair of motor-driven crimper rolls which define therebetween a nip through which the tow is advanced. In order to restrain the tow from wandering out of its intended travel path while passing through the nip, a pair of cheek plates, or crimper disks, are positioned on opposite ends of the rolls. The cheek plates include front faces which are pushed against the ends of the crimper rolls as the rolls rotate and are thus subject to considerable wear during operation.

This wear results from frictional contact between the cheek plates and the ends of the crimper rolls, and as the result of contact between the tow and the cheek plates at the center of the cheek plates. As regards the latter type of wear, the tow tends to be forced laterally outwardly (i.e., parallel to the axes of the crimper rolls), as it is forced through the nip and thus rubs against the center of the cheek plate faces. That rubbing contact damages the tow by an abrasion and fusing action and also wears the cheek plate face. As the worn area becomes enlarged, there is formed a gap between the cheek plate face and the nip, whereupon tow fibers may become wedged into that gap to produce further wearing of the cheek plate face and damage to the fiber by a cutting and tearing action. Eventually, the wear becomes substantial enough to require that the cheek plates be replaced. It should be noted that the wearing of the cheek plate faces occurs notwithstanding the fact that the faces are lubricated somewhat by finish liquid normally carried by the tow.

One manner of dealing with the problem of cheek plate wear involves the well-known technique of intermittently rotating the cheek plates. This does not reduce the rate of wear which occurs, but rather distributes the wear more evenly around the cheek plate face to increase the useful life of the cheek plate.

Another proposal involves the practice of lubricating the cheek plates by pumping a lubricating liquid through holes in the cheek plates as disclosed, for example, in Baken U.S. Pat. No. 3,662,439 issued May 16, 1972. The holes are spaced from the center of the cheek plate and are supplied with lubricant by means of channels formed in a holder which carries the cheek plate. That lubricant augments the lubrication provided by the finish carried by the tow. While such a proposal results in an increase in the lubrication of certain peripheral regions of the cheek plate face, other regions, such as at the center, do not have the lubrication increased appreciably. Generally speaking, the lubrication of that center region depends to a great extent upon the finish liquid carried by the tow. However, as the tow enters the nip, much of the finish liquid is squeezed from the tow; hence, the lubrication carried by the tow which contacts the cheek plate faces is significantly diminished.

It will thus be appreciated that significant room for improvement remains as regards the reduction of the wear of cheek plates.

It is, therefore, an object of the present invention to minimize or obviate problems of the type discussed above.

Another object is to reduce the wear occurring in the vicinity where the cheek plate face opposes the nip between the crimper rolls.

An additional object is to reduce cheek plate wear in a manner which is readily adaptable to rotary cheek plates as well as stationary cheek plates.

SUMMARY OF THE INVENTION

These and other objects of the invention are achieved by the present invention which relates to methods and apparatus for crimping textile fibers. In a method aspect of the invention, opposed crimping rolls are rotated about spaced rotary axes to force-feed the fibers through a nip defined by the rolls and into a stuffer box. A pair of cheek plates are pressed against the ends of the rolls such that a front face of each cheek plate retains the fibers against lateral displacement from the nip and such that the center of each cheek plate is offset relative to the nip in a direction toward one of the rotary axes. Lubricant is pumped through a passage extending centrally through each cheek plate and onto the front face thereof.

Preferably, each cheek plate is periodically rotated about an axis coinciding with the center of the cheek plate.

The lubricant preferably comprises a liquid which is pumped through hollow axles upon which the cheek plates are mounted.

In an apparatus aspect of the present invention, a crimping apparatus comprises a stuffer box and opposed motordriven rotatable crimper rolls mounted in front of the stuffer box for rotation about spaced axes of rotation. The rolls define a nip through which the fibers are force-fed into the stuffer box. A pair of cheek plates are disposed at opposite ends of the rolls such that a front face of each cheek plate is engageable with ends of the rolls adjacent the nip to retain the fibers against lateral displacement from the nip. Each cheek plate has a through-passage extending through the center of the cheek plate. Each cheek plate is disposed such that the center and through-passage is offset from the nip toward a rotary axis of one of the crimper rolls. A lubricant supply structure is provided for delivering lubricant to the passage of each cheek plate and onto the front face thereof.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
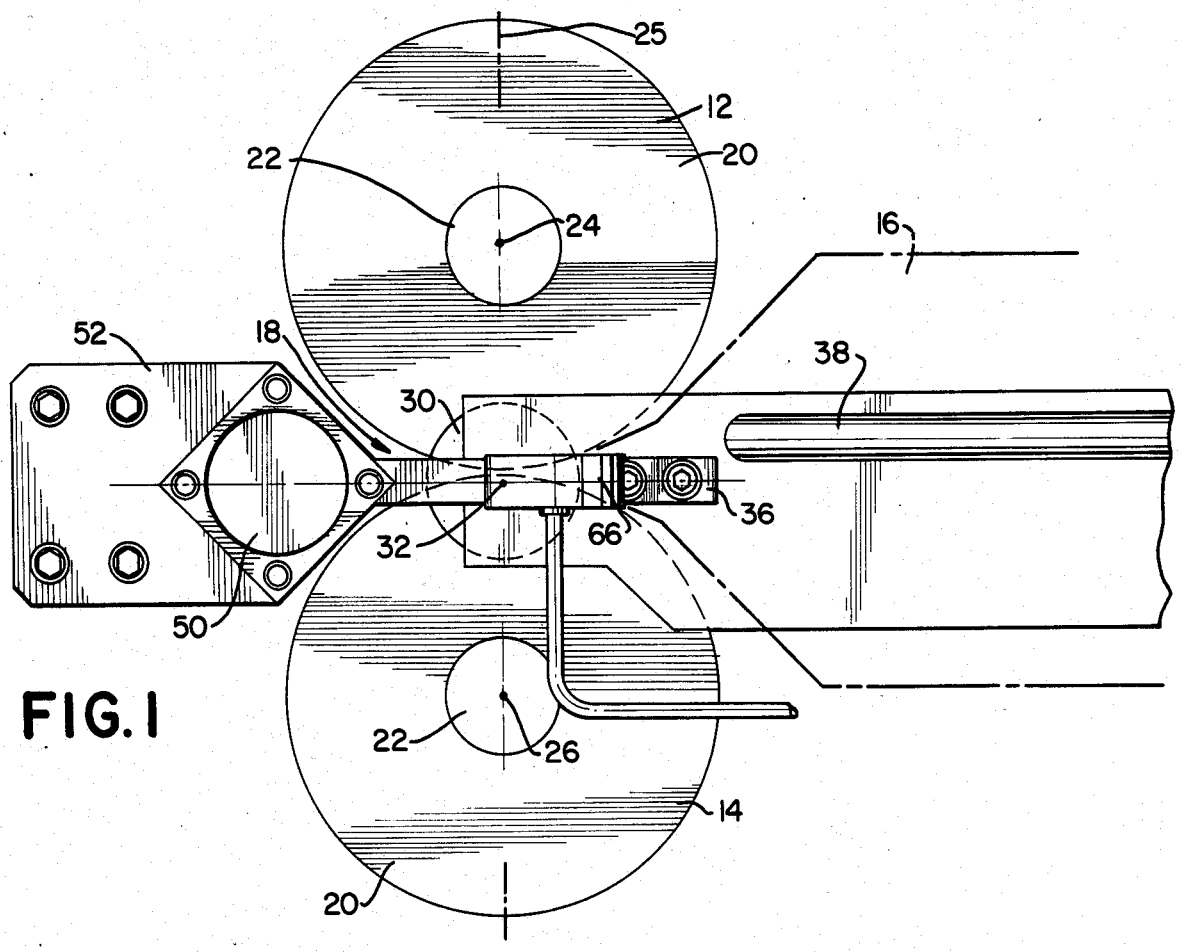
FIG. 1 is a side elevational view of a crimping apparatus according to the present invention.
Figure 2:
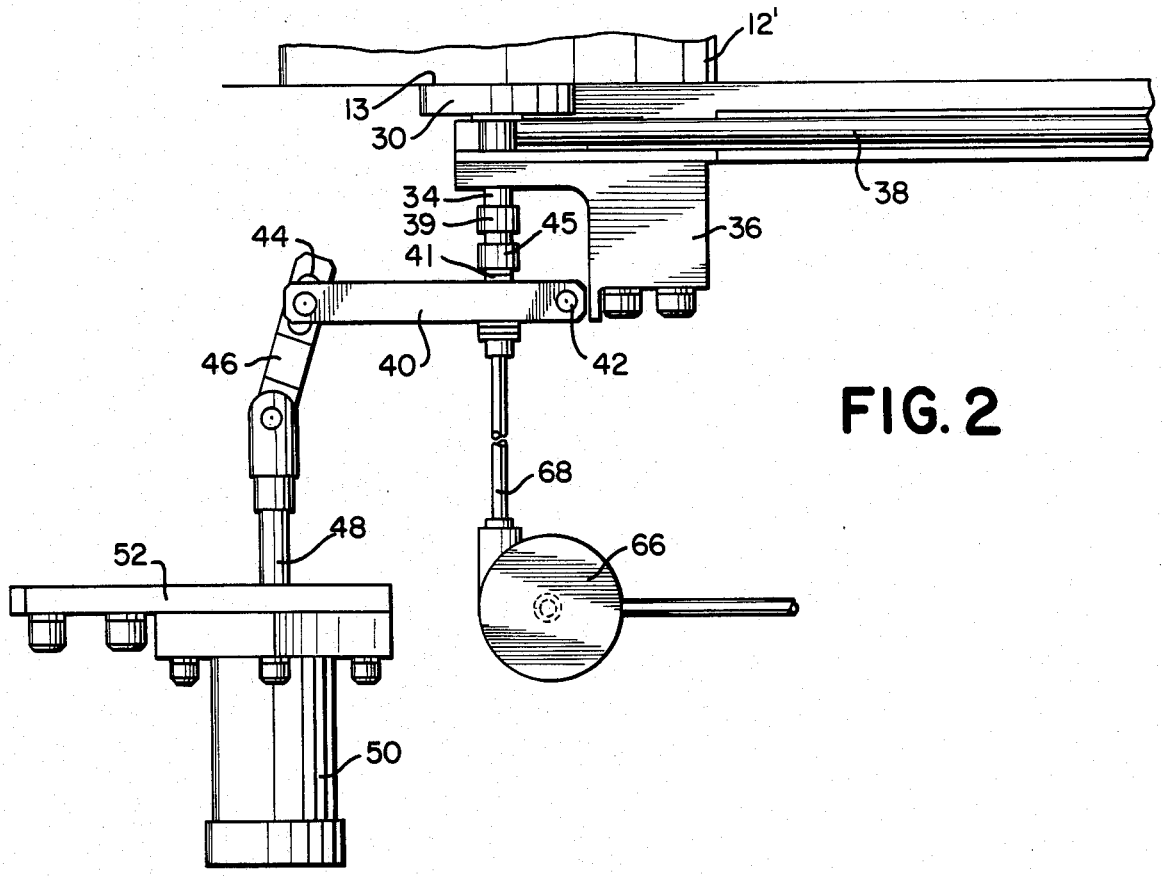
FIG. 2 is a top plan elevational view of the crimping mechanism depicted in FIG. 2.

A crimper mechanism depicted in FIG. 1 comprises a pair of motor-drive crimper rolls 12, 14 and a stuffer box 16 located downstream of a nip 18 defined between the rolls. Each roll comprises a stainless steel tire 20 mounted by shrink-fit on a center core 22. The rolls rotate about parallel axes of rotation 24, 26 disposed in an imaginary common vertical plane 25, the rolls being adapted to force-feed a tow, or bundle of fibers, horizontally into the stuffer box 16 during a conventional crimping operation.

In order to prevent the tow from wandering from the nip laterally of the horizontal direction of tow travel, a pair of cheek plates or crimper plates 30 are positioned on opposite sides of the roll assembly 12, 14 (only one crimper plate depicted in the drawing). Each cheek plate 30, which can be formed of any suitable material, such as a phosphorous/bronze composition for example, is pressed against the ends of the rolls 12, 14 such that a front face 13 of the cheek plate bears against portions of both rolls in the vicinity of the nip 18.

Each cheek plate can be stationarily mounted or of the power-driven type wherein it is intermittently rotated about a horizontal axis 32 disposed parallel to the axes of rotation 24, 26 of the crimper rolls 12, 14.

Each cheek plate is fixedly mounted on a horizontal axle 34, i.e., by screw threads 35. The axle 34 is mounted in a fixed frame 36 for rotation about its own longitudinal axis 32 and for longitudinal sliding movement toward and away from the rolls 12, 14 along that axis 32. A drive shaft 38 carried by the frame is rotatably driven by a suitable motor (not shown) and is drivingly connected to the axle 34 by means of a worm gear coupling 37 (schematically depicted) in a conventional manner. Thus, periodic rotation of the drive shaft 38 produces periodic rotation of the cheek plate 30 about the axis 32. The drive shaft 38 is mounted to accommodate a slight amount of longitudinal sliding movement of the axle 34 along the axis 32.

An end of the axle 34 opposite the cheek plate is connected to a non-rotary stub 34A by means of a suitable rotary joint 39. The stub shaft 34A is connected to a pipe 41 by means of a suitable quick disconnect coupling 45. The pipe 41 is connected to a link 40.

One end of the link 40 is mounted to the frame 36 by a vertical pivot pin 42 and the other end is loosely mounted in a slot 44 disposed at one end of an intermediate link 46. The other end of the intermediate link 46 is pivotably attached to a piston rod 48 of a fluid-actuated motor 50 which is supported on a fixed frame 52. It will be appreciated that extension and retraction of the rod 48 moves the cheek plate 30 toward and away from the crimper rolls 12, 14 in conventional fashion. Such a mechanism is provided for each of the cheek plates 30.

Each cheek plate 30 contains a passage 60 extending along the central axis thereof. The passage includes a section 62 of small diameter which opens at the cheek plate face 13, and a section 64 which opens to the back of the cheek plate. The axle 34 is secured by a screw connection within the large-diameter section 64. The axle 34, the stub shaft 34A, and the pipe 41 are all hollow to define a liquid conduit which communicates with the passage 60. A pump 66 communicates with that conduit by means of a hose 68 which is coupled to an end of the pipe 41. The pump draws liquid lubricant from a suitable source and delivers it to the conduit and thence to the face 13 of the cheek plate 30 through the passage 60.

Each cheek plate 30 is arranged such that its central axis 32, i.e., the rotary axis, is offset relative to the nip 18 in a direction toward the longitudinal axis of either of the crimper rolls. Thus, in a crimper mechanism of the type depicted wherein the crimper rolls 12, 14 are vertically superimposed, the cheek plate axis 32 is offset vertically. In a mechanism wherein the crimper rolls are horizontally spaced, the cheek plate axis would be offset horizontally.

The amount of offset, which is slight, locates the passage section 62 in non-alignment with the nip 18. In that way, the tow will not incur damage which would otherwise result if the tow engaged the edge of the passage. Also, it will be more difficult for fibers to enter and clog the passage 62.

Figure 3:
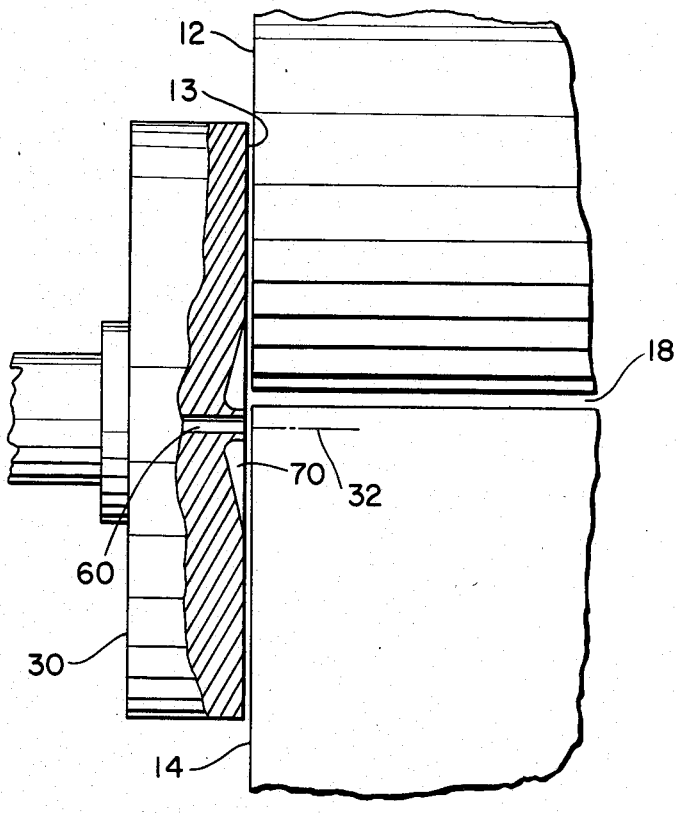
FIG. 3 is an enlarged, fragmentary elevational view, taken in a direction perpendicular to the axis of rotation of the crimper rolls, and with a portion of a cheek plate broken away, to depict, exaggeratedly, a wear pattern of a cheek plate according to the present invention.
Figure 4:
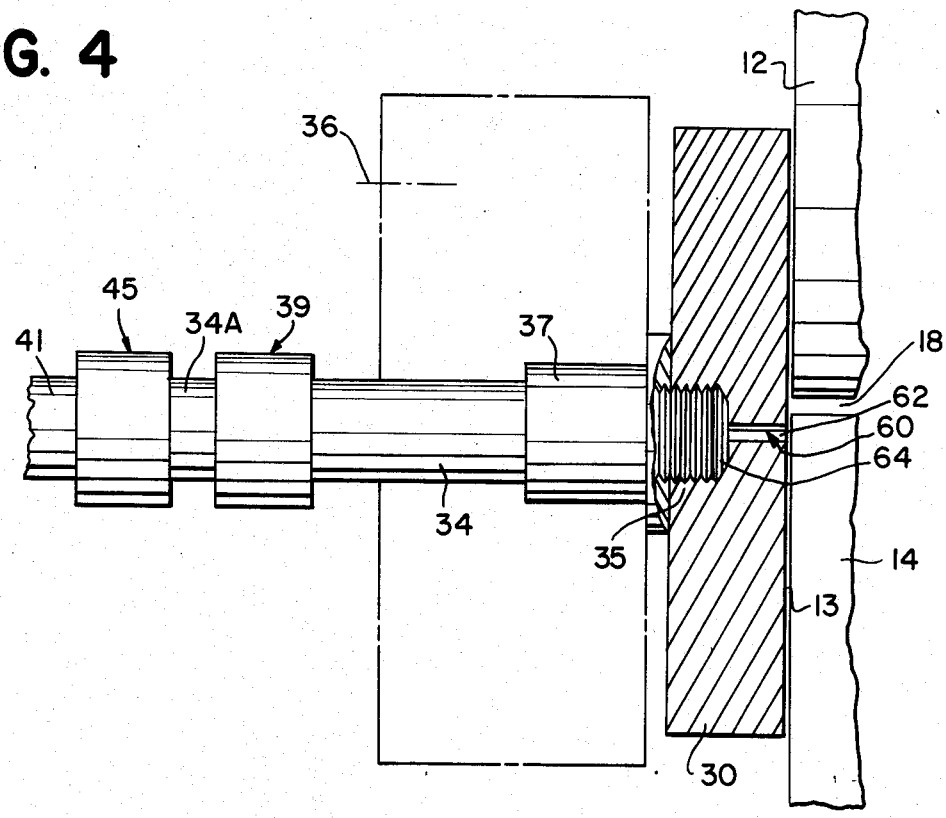
FIG. 4 is a view similar to FIG. 3 depicting the manner of rotatably mounting a cheek plate.

During a crimping operation, the tow rubs against the cheek plate face relatively intensely, but the potential damage to the fiber and cheek plate wear is greatly minimized by the lubricant emitted from the passage 62. Notwithstanding that lubrication, a certain degree of wearing of the cheek plate will occur. Depicted in FIG. 3 is the pattern of wear that will occur (shown exaggeratedly for the sake of clarity) in a cheek plate of the rotary type. As depicted, the wear pattern is in the form of an annular groove 70 extending coaxially about the passage 62, i.e., about the center axis of the cheek plate. As that groove 70 is being formed, it serves as a channel to guide and receive the lubricant from the passage 62. Thus, the lubricant will assuredly travel to the region most in need of lubrication to minimize the rate of wearing. The end of the passage 60 itself is isolated from substantial wear by the tow due to the offset relationship of the passage and nip. Thus, the end of the passage 60 remains in close proximity to the roll 14 to resist the entry of fibers into the passage..

IN OPERATION, the crimper rolls 12, 14 are rotatably driven to force tow into the stuffer box 16. The cheek plates 30 are pressed against the ends of the crimper rolls such that the center of the cheek plates are offset relative to the nip 18 along a common plane 25 containing the axes of rotation of the crimper rolls. Liquid lubricant, such as a mixture of water and textile finish, is pumped through the passage 60 in each cheek plate such that the lubricant flows onto the front face 13 of the cheek plate. That lubricant minimizes damage to the fiber and cheek plate wear which occurs as the result of the rubbing of the tow against the cheek plates. Cheek plate wear which does occur will take the form of an annular recess 70 (see FIG. 3) in the case of a rotary-type cheek plate, which surrounds the passage 60. That recess will serve to guide the lubricant into the recess, thereby assuring that the lubricant travels to the region where it is most needed, in order to minimize fiber damage and the rate of cheek plate wear.

The other regions of the cheek plates located radially outwardly of the recess will be lubricated by finish from the tow and/or by lubricant from the passage 60 which migrates radially outwardly.

It will be appreciated that the present invention minimizes damage to the fiber and cheek plate wear at the center of a cheek plate by supplying lubricant thereto in a manner which does not promote added wear of the tow (i.e., the passage 60 is offset from the nip and thus avoids contact with the tow), and which avoids clogging by the tow fibers (due to the offset relationship). This expedient is readily adaptable to cheek plates of the stationary type as well as the rotary-driven type and can be retro-fit onto existing crimper assemblies.

Although the present invention has been described in connection with a preferred embodiment thereof, it will be appreciated by those skilled in the art that modifications, substitutions, additions, and deletions, may be made, without departing from the spirit and scope of the invention as defined in the appended claims.

What I claim is:

1. A method of crimping textile fibers comprising the steps of:

rotating opposed crimping rolls about spaced rotary axes to force-feed the fibers through a nip defined by said rolls and into a stuffer box, pressing a pair of cheek plates against the ends of said rolls such that a front face of each cheek plate retains the fibers against the lateral displacement from said nip, and such that the center of each cheek plate is offset relative to said nip in a direction toward one of said rotary axes, rotating each cheek plate about an axis coinciding with the center of said cheek plate, and pumping lubricant through a passage extending centrally through each said cheek plate and onto said front face thereof, said pumping step including pumping liquid lubricant through hollow axles upon which said cheek plates are mounted.

2. A method according to claim 1, wherein each cheek plate is fixedly mounted on its respective axle, said rotating step comprising rotating said axles.

3. A crimping apparatus for textile fibers, comprising:

a stuffer box, opposed motor-driven rotatable crimper rolls mounted in front of said stuffer box for rotation about spaced axes of rotation and defining a nip through which the fibers are force-fed into said stuffer box, a pair of cheek plates disposed at opposite ends of said rolls such that a front face of each cheek plate is engagable with ends of said rolls adjacent said nip to retain the fibers against lateral displacement from said nip, each cheek plate having a through-passage extending through the center of said cheek plate, each cheek plate being disposed such that said center and through-passage thereof is offset from said nip toward a rotary axis of one of said crimper rolls, wherein each cheek plate is fixedly mounted on an axle, said axle being hollow and communicating with said through-passage to define a conduit which conducts liquid lubricant to said through-passage, drive means for periodically rotating each of said cheek plates about axes which associate with the center of each cheek plate, said drive means arranged to rotate said axle, and means for delivering lubricant to said through-passage of each cheek plate and onto said front face thereof.

4. Apparatus according to claim 3, wherein said crimper rolls are disposed vertically adjacent one another, said center of said cheek plate being vertically offset relative to said nip.

* * * * *